United States Patent [19]

Nezu

[11] Patent Number: 4,910,537

[45] Date of Patent: Mar. 20, 1990

[54] IMAGE FORMING APPARATUS

[75] Inventor: Yukihiro Nezu, Tokyo, Japan

[73] Assignee: Kabushiki Kaisha Toshiba, Kawasaki, Japan

[21] Appl. No.: 314,131

[22] Filed: Feb. 23, 1989

[30] Foreign Application Priority Data

Feb. 26, 1988 [JP] Japan ..... 63-43474
Feb. 26, 1988 [JP] Japan ..... 63-43475

[51] Int. Cl.[4] ..... G03G 15/01

[52] U.S. Cl. ..... 346/160; 346/153.1; 355/218; 355/233; 355/244; 355/326; 355/328

[58] Field of Search ..... 346/153.1, 160; 355/218, 233, 244, 326, 328; 340/700, 707

[56] References Cited

U.S. PATENT DOCUMENTS 3,688,267 8/1972 Iijima et al. ..... 340/146.3 Q
4,553,261 11/1985 Frofssl ..... 340/707 X
4,731,673 3/1988 Yamakawa ..... 346/153.1 X
4,737,804 4/1988 Ayata et al. ..... 346/153.1
4,791,452 12/1988 Kasai et al. ..... 346/160 X
4,831,408 5/1989 Yoshikawa et al. ..... 346/160 X
4,841,337 6/1989 Hiratsuka et al. ..... 346/153.1 X
4,847,654 7/1989 Honma et al. ..... 346/160 X

*Primary Examiner*—A. C. Prescott
*Attorney, Agent, or Firm*—Foley & Lardner, Schwartz, Jeffery, Schwaab, Mack, Blumenthal & Evans

[57] ABSTRACT

When a picture with a frame defining an image edition area on a document is read, a carriage including an exposure lamp is moved two times toward a fixed scale, from a stand-by position. With the movement in the same direction, two filters, first and second filters are switched from one to the other. The image data included in light passing through the switched filter is read by a CCD line sensor. A color of the first filter is different from that of the frame on the document. A color of the second filter is same as that of the frame. The image data read through the first filter by the CCD line sensor is stored into a first memory. The image data read through the second filter is stored into a second memory in the same order as that when the image data is stored into the first memory. A control unit properly processes the image data stored in the same orders, to obtain the image edition area.

18 Claims, 9 Drawing Sheets

IMAGE FORMING APPARATUS

BACKGROUND OF THE INVENTION

1. Field of the Invention

The present invention relates to an image forming apparatus, such as a copying machine, which is capable of designating a specific portion of a picture on a document, for example, and obtaining a copied picture in which a part of the picture corresponding to the designated specific portion is erased.

2. Description of the Related Art

Some types of recent electronic copying machines have various useful functions. One of those functions is an image designating function by which a specific portion of a picture on a document is designated before it is copied. Using the image designating function, the designated specific portion can be erased when it is copied. This specific portion erasing function is called trimming or masking.

In some copying machines of this type, a marker pen is used for designating a specific picture area to be edited on a document. The color of the maker pen is of the type in which a photosensitive drum of the copying machine is very sensitive to a mark written by the marker pen. In use, before the copying operation of the copying machine, the document is scanned by a scanner to recognize the marked picture area. To enhance the discrimination of the marked area from the remaining area of the picture, for example, color filters of the same color as that of the mark and of the color different from the same are inserted in an optical path in the scanner, every the marked area is scanned. The image data picked up through the scanning operation is stored into a memory. Then, the image data is read out and subjected to a proper arithmetic operation, so that the copying machine electronically recognized the designated specific area of the copied picture.

To realize other various functions, the designation of specific areas by the marker pen has been employed.

In the conventional copying machines of this type, for the above scanning, the color filters are properly switched during a reciprocal motion of the scanner. Therefore, the scanning direction as viewed by one filter is reverse to that by the other. To cope with this the image data collected through one of the color filters is reversed and stored. Alternatively, the image data collected through those filters are stored as intact. When it is read out, one of the two types of the image data is reversed. This approach brings about intricated signal processings.

Summary of the Invention

Accordingly, an object of the present invention is to provide an image forming apparatus which requires a simple signal processing for deciding a specific picture area as designated for various purposes, for example.

To achieve the above object, there is provided an image forming apparatus for reading image on a document, the document having a frame which defines an image edition area including image to be edit and has a color different from that of the image on the document, and for forming onto a copy member, image with applying a necessary image edition to the image edition area, the image forming apparatus comprising scanning means for scanning the document a plurality of times to obtain a plurality of light beams which have different wave lengths of light each other, one of the light beams which is obtained by a scanning operation having a wave length of light which corresponds to the color of the frame, drive means for moving the scanning means in the same direction for each scanning, thereby causing the scanning means to expose and scan the document, reading means for receiving the light beam and reading image data on the document, memory means for storing the image data read by the reading means, memory control means for storing every scanning into the memory means in the same order, the image data as read through the unidirectional scannings of the scanning means by the reading means, determining means for determining frame data corresponding to the image edition area on the document by using the image data of the memory means, and image forming means for receiving the light beam and forming onto the copy member, image corresponding to the light beam, with applying the necessary image edition to the image edition area determined by the determining means.

DETAILED DESCRIPTION OF THE PREFERRED EMBODIMENTS

Figure 1:
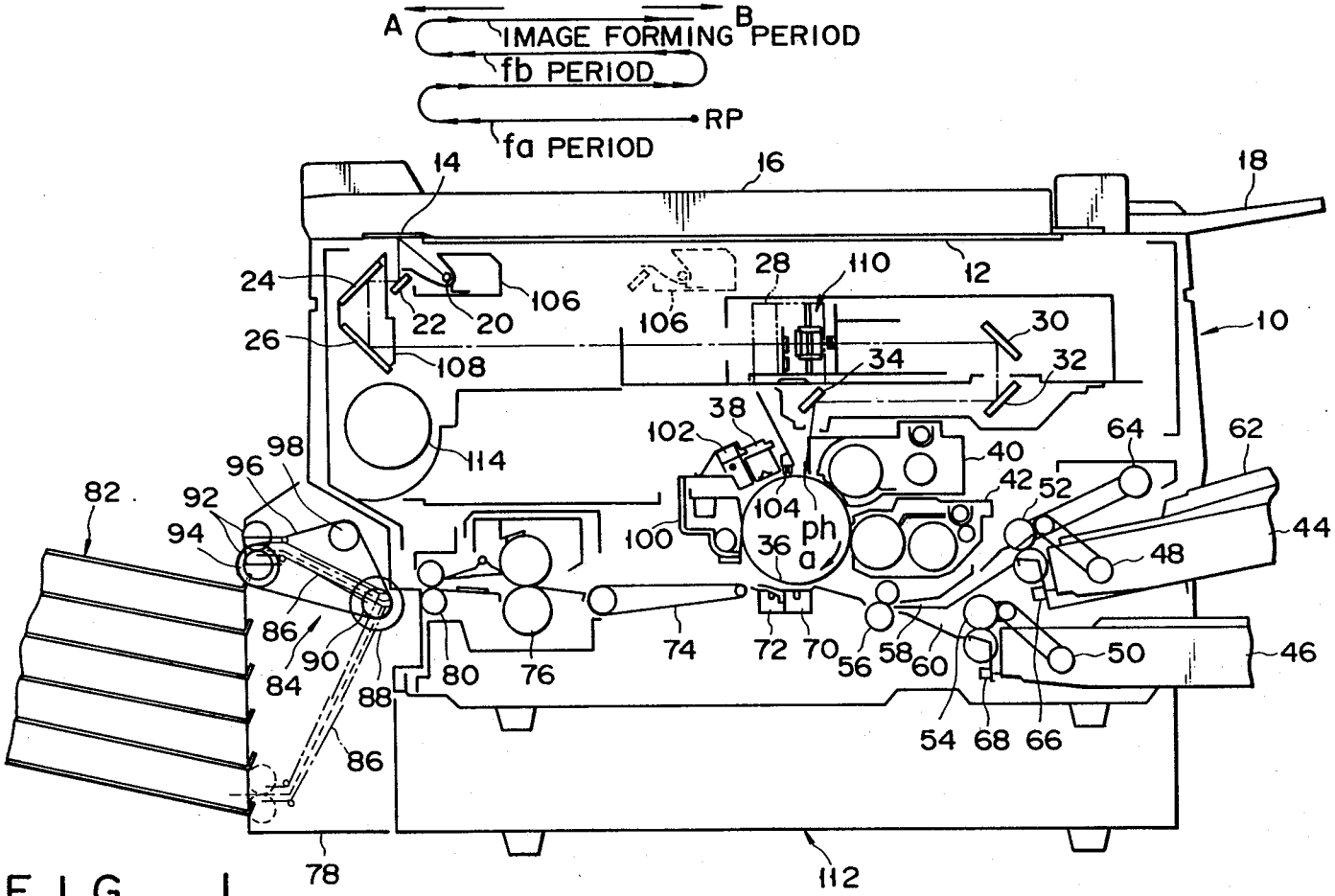
FIG. 1 shows a longitudinal sectional view of an overall mechanical structure of an image forming apparatus according to an embodiment of the present invention.

A rough sketch of the innards structure of a image forming apparatus according to the present invention is given in FIG. 1. In the description to follow, an image forming apparatus according to the present invention is implemented into a copying machine. A table 12, which is made of transparent glass and supports an original, for example, a document, is provided on the top surface of a main frame 10 of the copying machine. A fixed scale 14 for providing references when a document is set on the table 12, is used for the table 12. An automatic document feeder 16 is further installed above and in connection with the table 12. The document feeder 16 automatically feeds documents set on a work table 18 toward the table 12 in successive manner, and sets them sheet by sheet on the table 12. A tray (not illustrated) is provided on the top surface of the document feeder 16, and receives the documents that have optically been scanned.

A document set on the table 12 is optically scanned through reciprocative motions of an optical system under the table 12. The optical system is made up of an exposure lamp 20, and a set of mirrors 22, 24 and 26. Mirrors 24 and 26 moves at the half speed of the mirror 2, in order to keep a specific length of an optical path. The rays of light reflected from the document during the scanning operation, viz., the rays of light that are emitted from the exposure lamp 20 and reflected on the document, are reflected successively at the mirrors 22, 24 and 26, and passed through a lens block 28 for varying a magnification. The light passed through the lens block 28 is then reflected successively at mirrors 30, 32 and 34. The reflected light is introduced onto a photosensitive drum 36, so that an image of the document is formed on the surface of the drum 36.

The drum 36 rotating in the direction of arrow "a" is charged by a charger 38. The charged drum surface is exposed to the light including the image data, which is applied through a slit of an exposure unit Ph. Through the slit-exposure, a latent image of the original image is formed on the drum surface. The drum 36 further rotates to place the drum surface bearing the latent image under selectively operated developers 40 and 42 containing different colors such as black and red. The two types of toner are applied onto the drum surface, so that the latent image is visualized.

A stack of paper as sheets on which an original image is to be copied is contained upper and lower cassettes 44 and 46 of different sizes. The paper is picked up sheet by sheet from the selected cassette 44 or 46, by a combination of roller 48 and paired rollers 52, or the roller 50 and paired rollers 54. The picked up paper is transported through guide paths 58 or 60 and a regist roller pair 56, and reaches a transfer section. The upper cassette 44 is provided with a guide 62 for manual feed. Paper is transported by a combination of a feed roller 64, the roller pair 52, and guide path 58 and reaches the regist roller pair 56, and then is moved to the transfer section by the regist roller pair 56.

As shown, the paper cassettes 44 and 46 are removably set in the lower part of the right side of the main frame 10. A desired cassette of those 44 and 46 is selectable by operating related keys on an operation panel to be detailed later. Switches 66 and 68 for designating size of the cassettes is provided in connection with the cassettes 44 and 46, respectively. These cassette size detecting switches 66 and 68 includes a plurality of microswitches, respectively. Each microswitch is driven by setting the corresponding cassette to the main frame 10 of the copying machine, and is turned on or off.

In the vicinity of a transfer charger 70 of the transfer section, the copy paper is in close contact with the surface of the photosensitive drum 36, so that the toner image is transferred from the drum surface onto the copy paper with the aid of the charger 70. The copy paper bearing the transferred image reaches the location of a separation charger 72, and is separated from the drum 36 by the charger 72, and further moved forwardly by a belt 74 toward a fixing section. A fixing roller pair 76 as the fixing section is located at the end of the transfer belt. When the paper passes the fixing section, the toner image on the paper is fixed. The paper after passed the fixing section is introduced by means of a transfer roller pair 80 to a known sorter 78 installed outside the main frame 10.

A plurality of trays 82 are provided extending outside from the sorter 78. The sorter 78 contains a paper transfer section 84. An extensible path 86 for guiding the paper emanating from the roller pair 80 is further contained in the paper transfer section 84. A motor 88 for driving a pulley 90 is provided at the base end of the transfer path 86. An exit roller pair 92 for discharging the paper from the path 86 into the tray 82 is provided at the distal end of the path 86. One of the paired roller 92 is coupled with another pulley 94. A timing belt 96 is wound around these pulleys 90 and 94. The combination of the path 86 and the roller pair 92 is swingable about the pulley 90, and in operation is swung toward an intended tray 82. The pulley 98 maintains a tension of the timing belt 96 at a fixed value.

The toner left on the surface of the photosensitive drum 36 after passed the transfer section is removed by a cleaner 100. A quench lamp 102 erases the residual image. Finally, the drum surface returns to the original state. For example, between the charger 38 and the exposure section Ph, an erasure array 104 as an erasure means is disposed in proximity to the drum surface.

The erasure array 104 is made up of a plurality of light emitting diodes arrayed along the width of the drum 36. These diodes are selectively lit on to quench the charge on the drum surface. The exposure lamp 20 and the mirror 22 are installed in a first carriage 106, while the mirrors 24 and 26, in a second carriage 108. When the copying machine is in a stand-by mode, the first carriage 106 is located at a position indicating a base line of a copying area as defined by the paper size of the currently used paper and a copy magnification, viz., a stand-by position RP as indicated by a dotted line in FIG. 1.

An image reader 110 is located by the lens block 28. The main frame 10 is placed on a table 112. A cooling fan 114 further provided in the main frame 10, to restrain a temperature rise within the main frame.

Figure 2:
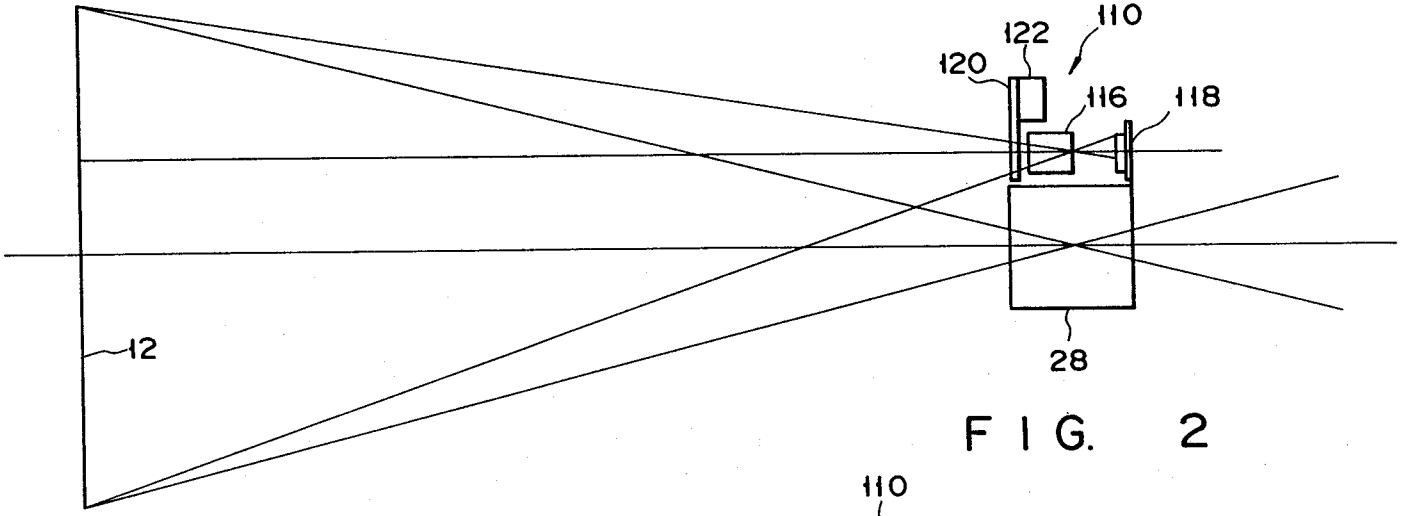
FIGS. 2 and 3 are views optically and mechanically illustrating a structure of a scanner used in the image forming apparatus.
Figure 3:
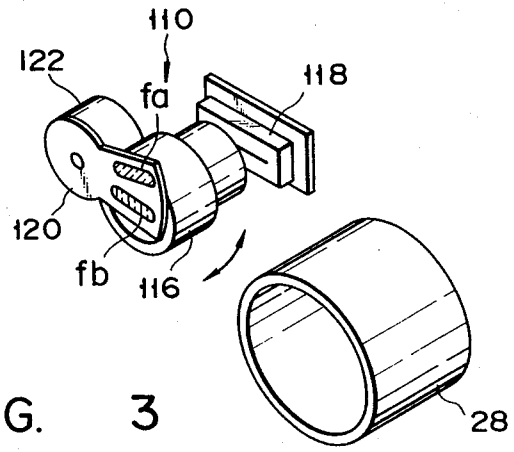

The structural illustration of the image reader 110 is given in FIG. 2. The light containing the image information as introduced by the combination of the exposure lamp 20, and mirrors 22, 24 and 26, is led to a CCD line sensor 118 by means of a lens 116. A filter member 120 is placed in front of the lens 116. One side of the filter supporting member 120 is rotatably connected to a rotary solenoid 122. The solenoid is energized to swing the filter supporting member 120 in the directions of arrowheads. The other side of the filter supporting member 120 is provided with a red filter fa and a blue filter fb. By properly swing the filter supporting member 120, one of the filters fa and fb is exactly aligned with the optical path of the lens 116.

Figure 4:
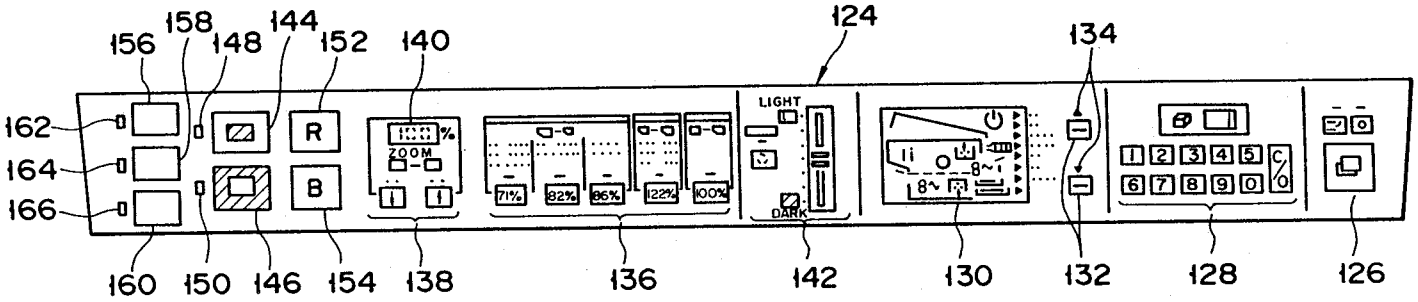
FIG. 4 shows a top view of an operation board used in the image forming apparatus.

The illustration of FIG. 4 shows an operation panel 124 of the main frame 10. Many keys, indicators and the like are laid out on the operation panel. The operational panel 124 includes: a start key 126 for starting a copying operation; ten keys 128 for setting a number of copies; an indicator 130 for indicating operating states at the respective portions of the copying machine, jamming of copy paper, and the like; cassette select keys 132 for selecting either of the upper and lower cassettes 44 and 46; cassette indicaters 134 for indicating the selected cassette; magnification keys 136 for stepwise setting a magnification of a copied image for enlargement add reduction; zoom keys 138 for continuously setting a magnification of a copied image for magnification and reduction; a display window 140 for displaying numerals representative of a set magnification; and a gradation key 142 for setting a desired graduation of the gray level of a copied image.

The operation panel 124 further includes erasure keys 144 and 146, and light emitting elements 144 and 146 for indicating that the erasure keys 144 add 146 are now operated. When the key 144 is operated, the image within a area as designated is erased. When the key 146 is operated, the image outside the designated area is erased. A red key 152 is further provided to designate the developer 40 containing red toner. A key 154 is further provided for designate the developer 42 containing black toner.

Further laid out on the operation panel 124 are a stack key 156, a sorting key 158, and a page sorting key 160, and light emitting elements 162, 164 and 166 showing those keys being operating.

Figure 5:
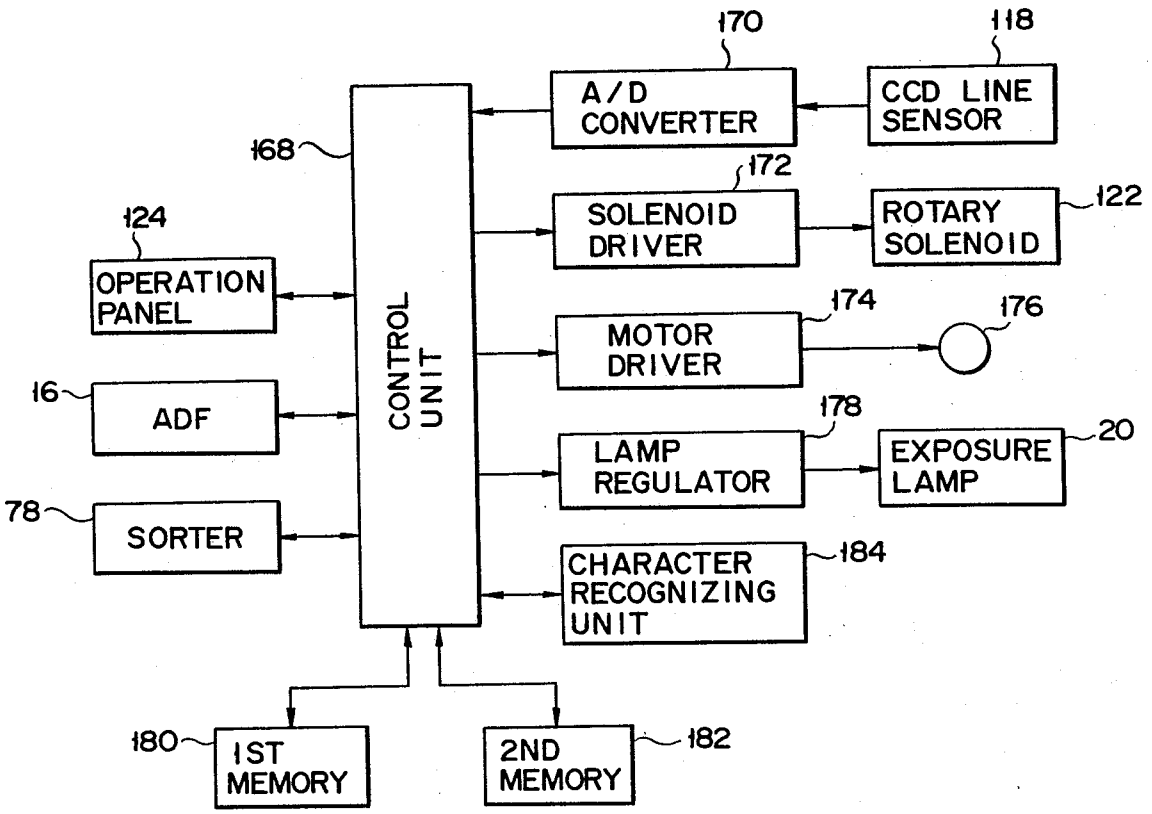
FIG. 5 is a block diagram showing a major portion of a control system used in the image forming apparatus.

FIG. 5 shows a circuit configuration of a major portion of a control system of the copying machine. In the control system, a control unit 168, which substantially includes a microprocessor, for example, executes an overall control of the copying machine. The control unit 168 is coupled with the operation panel 124, the automatic document feeder (ADF) 16, and the sorter 78. Of those circuit blocks further coupled with the control unit 168, an A/D converter 170 converts an output signal of the CCD line sensor 118 into a digital signal. A solenoid driver 172 drives the rotary solenoid 122. A motor driver 174 controls the drive of a motor 176 for driving the first and second carriages 106 and 108. A lamp regulator 178 controls the light on and off of the exposure lamp 20. First and second memories 180 and 182 store the output data signals of the A/D converter 170. A character recognizing unit 184 recognizes pages of the document image data stored in the memories 180 and 182.

A level of the output data signal of the CCD line sensor 188 when it receives the light passed through the filter fa is different from that when it receives the light passed through the filter fb. To eliminate such an output level difference, the control unit 168 changes the threshold level of the data signal from the A/D converter 170 in accordance with the filters fa and fb. Alternatively, the read tim of the CCD line sensor 118 may be changed in accordance with the filters fa and fb.

The character recognizing unit 184 may be any type of recognizing unit if it can recognize numerals, such as a known recognizing unit as disclosed in U.S. Pat. No. 3,688,267.

An operation of the copying machine thus arranged will be described with reference particularly to FIGS. 6A through 6E, and FIG. 7.

Figure 6C:
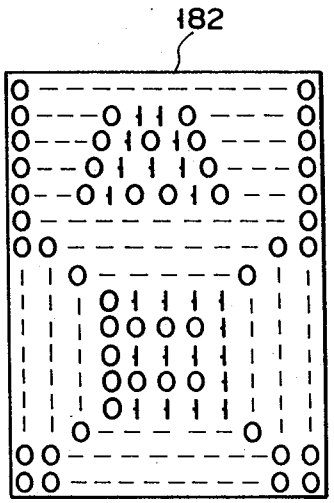
FIGS. 6A through 6E show views useful in explaining the operation of the image forming apparatus according to the present invention.
Figure 6B:
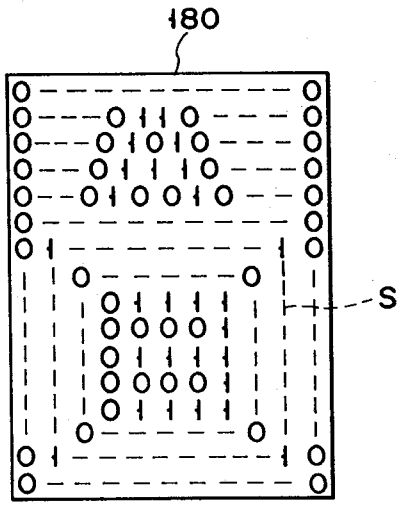
Figure 6A:
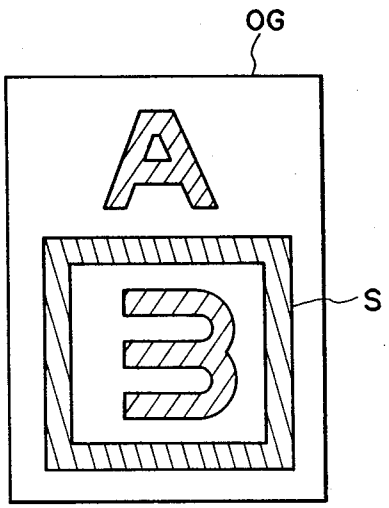
Figure 6E:
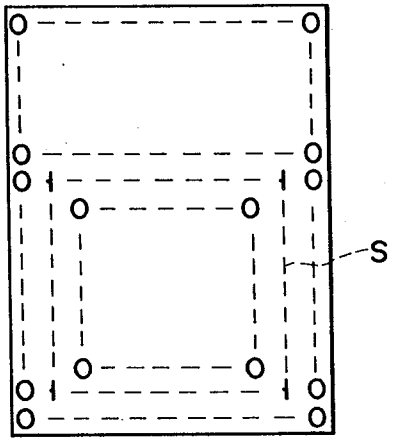
Figure 7:
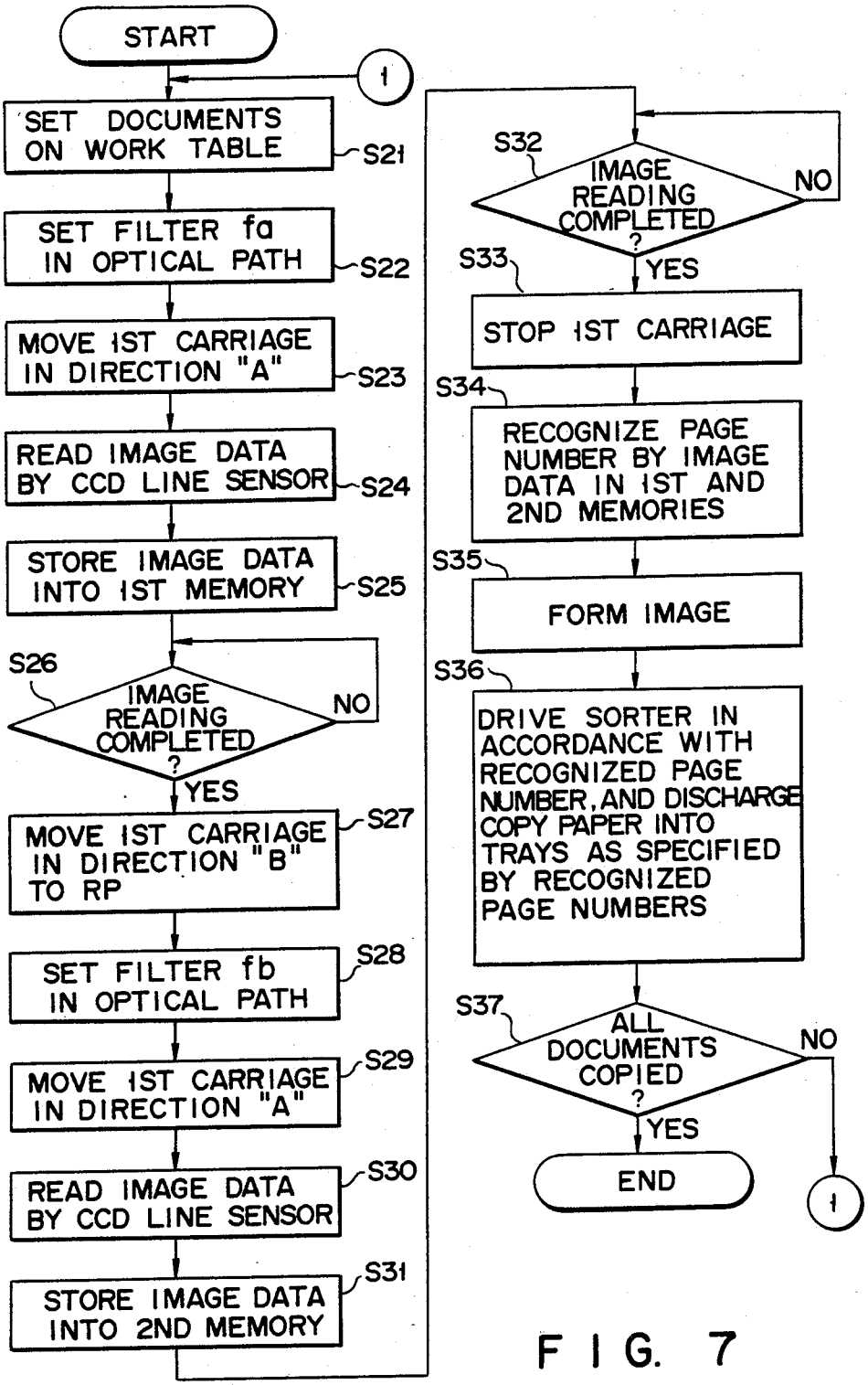
FIG. 7 shows a flowchart useful in explaining the operation of the image forming apparatus.

It is assumed now that a set of documents OG with different page numbers are set on the work table 18 of the automatic document feeder 16, and that a page area S has been designated by a marker pen as shown in FIG. 6A. Preferable is the marker pen having a color to which the photosensitive drum 36 is highly sensitive. When selenium Se, for example, is used for the photosensitive drum, the preferable color is blue and its family. Under this condition, the page sorting key 160 on the operation panel 124 is operated, and then the copy key 126 is operated. In response to those key operations, the control unit 168 in the control system starts a sequence of control operations for copying as shown in FIG. 7.

As seen from the flowchart, the automatic document feeder 16 is operated to pick up a sheet of document OG rom the set of documents on the work table 18, and to set it on the document table 12 (step S21). The solenoid drive circuit 172 drives the rotary solenoid 122, so that the filter supporting member 120 is rotated to place the red filter fa in the optical path of the lens 116 (step S22). In turn, the lamp regulator 178 lights on the exposure lamp 20. At the same time, the motor drive circuit 174 drives the motor 176, so that the first carriage 106 is moved from the stand-by position RP (FIG. 1) toward the fixed scale 14 (in the direction of arrow "A" in FIG. 1). Under this condition, the document OG is optically scanned (step S23) During the above steps of operations, the devices relating to the developing process such as the photosensitive drum 36 and charger 38, are not operated With progression of the scanning operation, the light reflected from the document OG is guided by the mirrors 22 through 26, passes through the red filter fa and the lens 116, and is incident on the CCD line sensor 118. The image data contained in the light is read by the sensor 118, and converted into an electrical analog signal representative of the image data (step S24). The analog signal is digitized by the A/D converter 170. The digitized image data from the converter 170 is stored into the first memory 180 (step S25). A pattern of bits contained in the digitized image data is as shown in FIG. 6B. At the completion of the image data reading operation by using the red filter fa (step S26), the exposure lamp 20 is lit off and the first carriage 106 is moved in the direction of arrow "B" (FIG. 1) and returned to the stand-by position RP indicating the bas line of a copying area (step S27).

Then, the rotary solenoid 122 is driven by the solenoid drive circuit 172, so that the blue filter fb of the filter supporting member 12 is set in the optical path of the lens 116 (step S28). Under this condition, the exposure lamp 20 is lit on by the lamp regulator 178, while at the same time the motor 176 is driven by the motor drive circuit 174. The first carriage 106 is moved from the stand-by position RP shown in FIG. 1 toward the fixed scale 14 (in the direction of arrow "A" in FIG. 1), to optically scan original OG again (step S29). During the above process of operation, the devices contained in the developing section such as the photoconductive drum 36, charger 38, and the like are likewise at a standstill.

During the course of the exposure and scanning operation, the light reflected from the document OG and guided by the mirror 22 to 26 is incident on the CCD line sensor 118 via the lens 116, so that the image data contained in the light is read by the line sensor 118 (step S30). The output signal derived from the line sensor 118 is converted into a corresponding digital signal by the A/D converter 118. The digital signal containing the original image data is stored into the second memory 182 as shown in FIG. 6C (step S31). Upon completion of the image reading operation using the blue filter fb (step S32), the exposure lamp 20 is lit off and the first carriage 106 is stopped at the position of the fixed scale 14 (step S33).

Figure 6D:
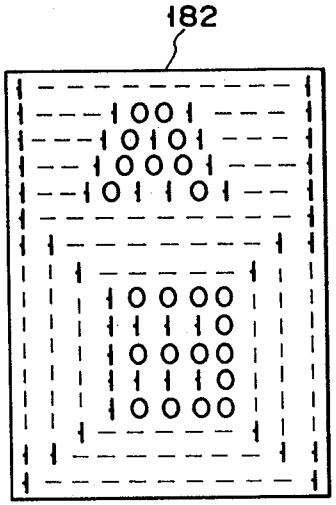

Under this condition, the control unit 168 and the character recognizing unit 184 recognizes the page number on the basis of the image data stored in the first and second memories 180 and 182 (step S34). To be more specifically, the control unit 168 inverts the data stored in the second memory 182 as shown in FIG. 6D. The inverted data is logically multiplied by the data of the first memory 180 shown in FIG. 6B. The logical product obtained represents a bit array shown in FIG. 6E. The bit array definitely contours the page area S. Following recognition of the page area S by the control unit 168, the character recognizing unit 184 recognizes the page number, or its numerals, on the basis of the image data in the page area S stored in the first memory 180.

Figure 8:
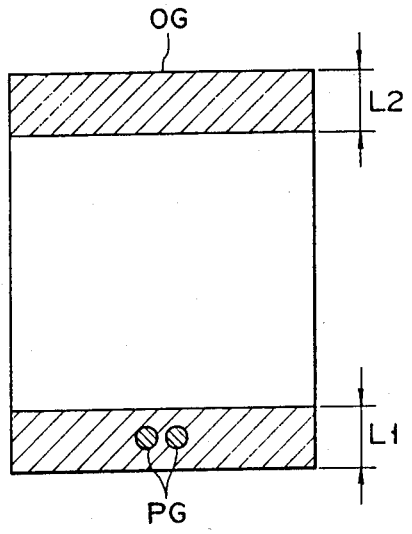
FIG. 8 shows a vie for explaining a location of a page number on a general document.

Generally, a page number is located in the bottom part of a document. Therefore, the above logical operations, such as the inversion and logical multiplication of the image data stored in the first and second memories 180 and 182, may be applied only to a shaded area L1 (approximately 3 cm) in the bottom part of an original OG as shown in FIG. 8. If the occasion arises, another area such as an upper shaded area L or both areas L1 and L2 may be subjected to the logical operations.

Following the recognition of the page number, an image forming operation starts (step S35). The lamp regulator 178 lights on the exposure lamp 20. At the same time, the motor drive circuit 174 drives the motor 176, so that the first carriage 106 moves from the scale 14 in the direction of arrow "B" in FIG. 1 to expose and scan the document. With the scanning operation, the photoconductive drum 36, charger 38 and the like are operated and the image on the document are transferred onto a copy paper. The paper bearing the transferred image is supplied to the sorter 78 by way of the fixing roller pair 76 and the transfer roller pair 80.

This sorter 78 is controlled by the control unit 168 so that one of the exit trays 82 is selected according to the page number as recognized by the character recognizing unit 184. When the recognized page number is "1", the exit roller pair 92 and the transfer path 86 are moved to the uppermost exit tray 82. The copy paper with the transferred image is discharged into the tray 82. For "4" of the recognized page number, the exit roller pair 92 and the transfer path 86 are moved to the fourth exit tray 82 as counted from the top. The copy paper with tee transferred image is discharged into this tray 82 (step S36). The above sequence of operation is repeatedly applied for all the documents on the work table 18 (step S37). When the sequence of the operation for the final document is completed, the copying operation ends. As a consequence, the copied papers are automatically sorted into trays for the page numbers.

As seen from the above description, when the control unit 168 recognizes the page area S on the document, the first carriage 106 is moved two times from the stand-by position toward the fixed scale 14. With the movement of the first carriage in the direction of arrow "A", the filter fa is switched to the filter fb for the image reading of the page area by the CCD sensor 118. In the case of reading an image by switching the filter fa and fb, the direction of reading the document through the filter fa is the same as that through the filter fb. Therefore, the image data stored into the first memory 180 has the same direction as that stored into the second memory 182. This makes the signal processing simple.

In the embodiment of the copying machine, before the image forming operation, pictorial information on a document is read by the image reader 110. The character recognizing unit 184 appropriately processes the read image data and recognizes a page number of the document. The recognized page number drives the sorter 78 to put the paper bearing the image of that document into the tray corresponding to the page number attached to the document. Accordingly, if the documents are stacked randomly in page number on the work table 18 of the automatic document feeder 16, the copied papers are automatically sorted into the trays for page numbers. Therefore, there is no need for the manual work to rearrange the copied papers for page numbers.

Figure 9:
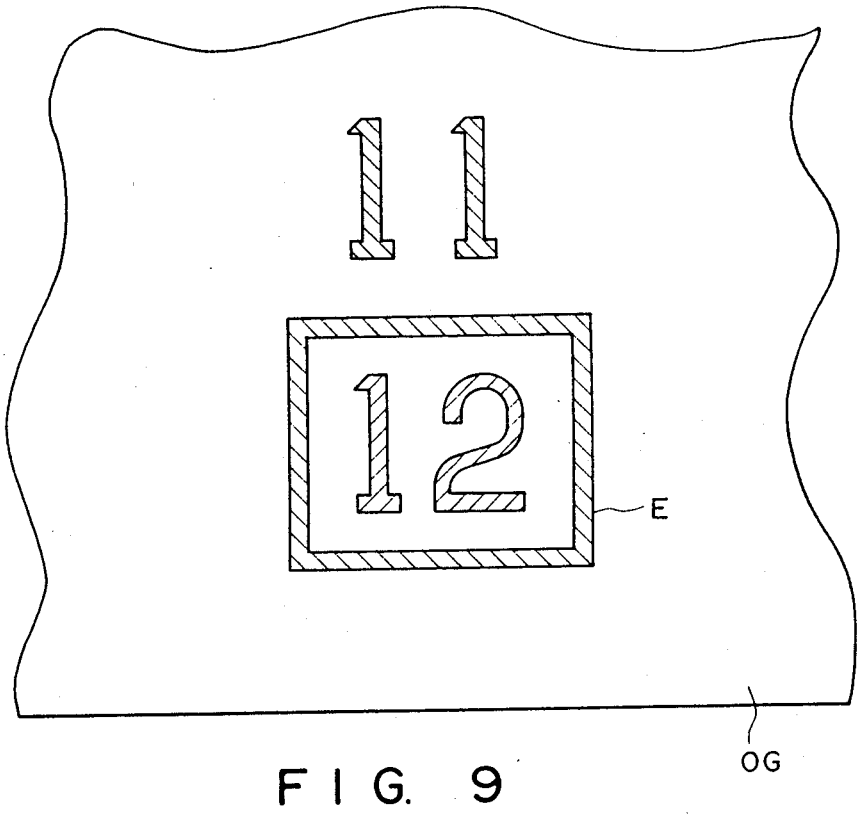
FIG. 9 is a view showing a part of a document useful in explaining the operation of a second embodiment of an image forming apparatus according to the present invention.
Figure 10:
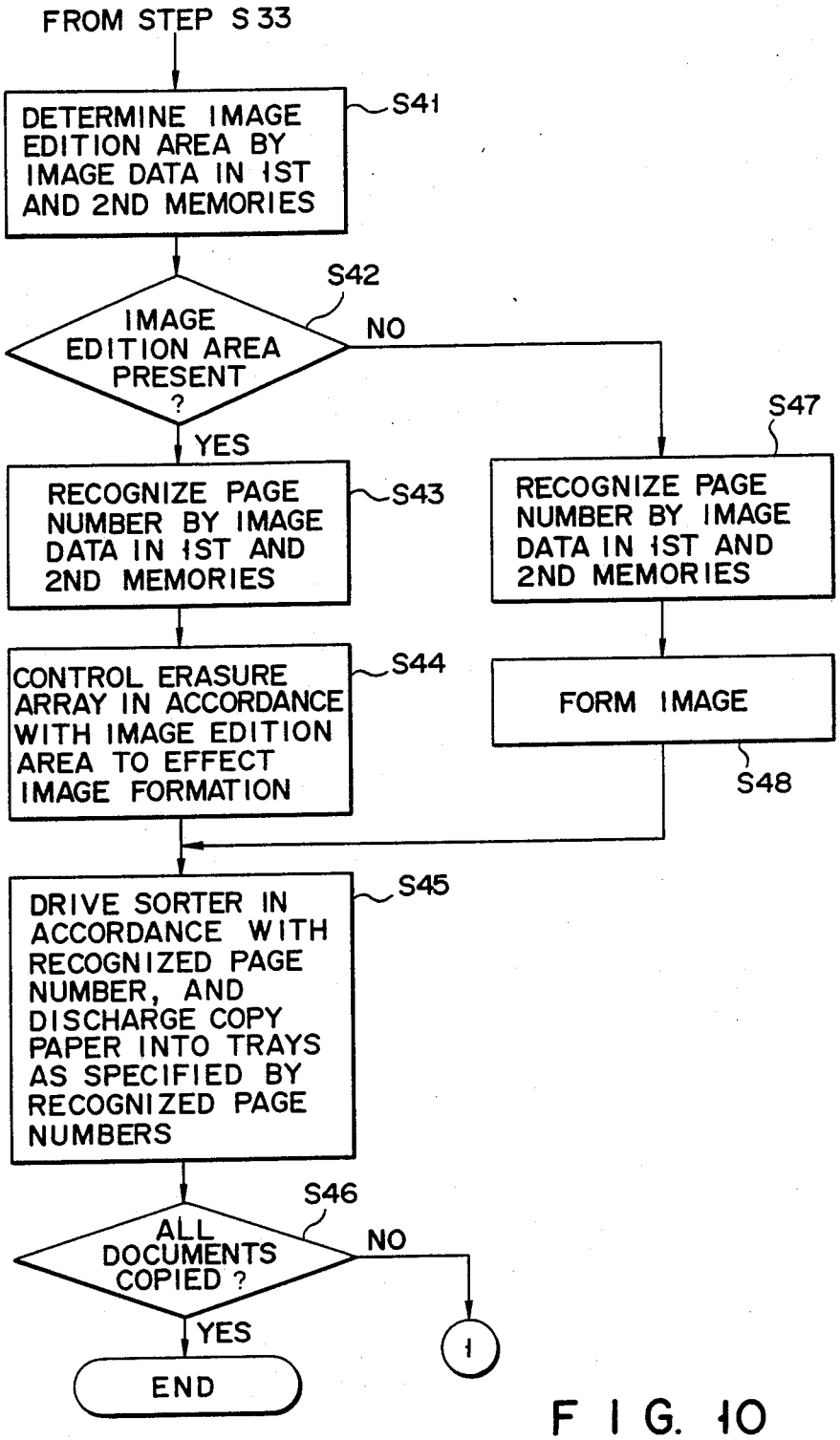
FIG. 10. shows a flowchart useful in explaining the operation of the image forming apparatus according to the second embodiment.

An another embodiment of a copying machine according to the present invention will be described with reference to FIGS. 9 and 10.

A plurality of documents with page numbers are set on the work table 18 of the automatic document feeder 16. On a document to be changed to another page number, an operator encloses the changed page number (12 in this instance) by a square ring, by using a marker pen, as shown in FIG. 9. This is done in order to designate an image edition area E. Further, he writes a corrected page number (11 in this instance) near the edition area E with the marker pen. Under this condition, he operates the erasure key 144 and the page sorting key 160 on the operation panel 124, and then pushes the copy key 126. Upon depression of those keys, the control unit 168 performs a sequence of operations as flowcharted in FIG. 10.

The steps S21 through S33 in FIG. 7 are executed to store the image data into the first and second memories 180 and 182.

The image edition area E designated by the marker pen is decided on the basis of the image data of the first and second memories 180 and 182, as the recognition of the page area S in the above embodiment (step S41).

In the next step S42, the control unit decides if the image edition area E is present. If the answer is YES, or a page number correction is designated, the control unit specifies a page in the document image by using the image data from the first and second memories 180 and 182 (step S43). More specifically, the control unit applies the logical operations such as the inversion and logical multiplication to the image data of the first and second memories. If the image data of "1's" exist in the vicinity of the image edition area E as decided in step S41, the control unit 168 decides the image data as page number data. The character recognizing unit 184 properly processes the page number data to recognize a page number, or numerals.

After the image edition area E and the page number are recognized, the copying machine performs the operation for forming an image except the edition area E (step S44). The photosensitive drum 36 is rotated, the charger 38 charges the surface of the drum 36, while at the same time the light emitting diodes of the erasure array 104, which are located within the recognized area E, are selectively lit on to quench the charge on the drum surface within the area E.

At the same time, or at the instant that the quenching operation terminate, the first and second carriages 106 and 108 are moved to optically scan the picture on the document. Through the scanning operation, the drum 36 is illuminated with the light from the document OG, but no latent image is formed on the charge removed area on the drum surface. Therefore, in a developed image, it portion corresponding to the charge removed area, or the image edition area E, is lack of an image.

A copy paper having an image thus formed is supplied to the sorter 78. The sorter 78 selects one of the tray 22 that corresponds to the page number recognized by the character recognizing unit 184, and puts the received copy paper into the selected tray (step S45). At this point, if additional documents exist on the work table 18 (step S46), the copying machine repeats tee above sequence of editing and copying operations till the document on the work table runs out. If there is no document on the work table (step S46), the copying operation ends.

When the image edition area E is not found (step S42), viz., a page correction is not required, the control unit 168 and the character recognizing unit 184 properly processes the image data of the first and second memories 180 and 182, to obtain a page number of the document under copying (step S47). Since a document OG generally has its page number PG in the bottom portion of the document as shown in FIG. 8, a lower shaded band area L1 (of about 3 cm wide) of the document OG is treated as an area to be subjected to the character recognition by the character recognizing unit 184. When image data exists within the band area L1 and no image data exists on both sides of the former, the existing image data is decided as the page number data by the character recognizing unit 184. Incidentally, if occasion demands, the recognized area may be L1 and/or L2.

After the image edition area E and the page number are recognized, the copying machine performs an image forming operation, as in the above embodiment (step S48). A copy paper having an image thus formed is supplied to the sorter 78. The sorter 78 selects one of the trays 82 that corresponds to the page number recognized by the character recognizing unit 184, and puts the received copy paper into the selected tray (step S46). All the documents on the work table have been copied (step S47), and the copying operation ends. The copy papers thus copied, which includes the copy papers with the corrected page number, have been orderly arranged in the trays 82 for each page number.

In the second embodiment of the copying machine, before the image forming operation, pictorial information on a document is read by the image reader 110. The control unit appropriately processes the read image data and recognizes an image edition area, and executes an image forming operation. If a page number correction is required for a document or documents, the same is executed. The recognized and corrected page number drives the sorter 78 to put the paper bearing the image of that document into the tray corresponding to the page number (including a corrected page number) attached to the document. Therefore, it is only needed for an operator to stack the documents including those with corrected page numbers randomly in page number on the work table 18 of the automatic document feeder 16. If so done, the copied papers are automatically sorted into the trays for page numbers. This eliminates the operator's manual work to arrange the copied papers in the order of page numbers, remarkably alleviating the operator's work in connection with the copying machine.

In the above-mentioned embodiments, the two filters of different colors, red and blue are used. Alternatively, a single filter of blue, for example, may be used for the same purpose. In this case, a picture image on the document is first read not through the blue filter. Then, it is read again through the filter.

To change a wave length of the image reading light, the above-mentioned embodiments switch a filter of one color to another filter of another color. An alternative uses an exposure lamp capable of emitting different types of image reading light whose colors are different. In use, one image reading light is switched to another for changing the wave length of the light.

The embodiments each employ the automatic document feeder, but it is not essential, and copy papers may be fed manually, as a matter of course.

While some specific embodiments have been described, it is understood that the present invention may variously be changed and modified within the spirits and scope of the invention.

What is claimed is:

1. An image forming apparatus for reading an image on a document, the document having a frame which defines an image edition area including image to be edited and has color different from that of the image on the document, and for forming onto a copy member, image with applying a necessary image edition to said image edition area, said image forming apparatus comprising:

scanning means for scanning the document a plurality of times to obtain a plurality of light beams which have different wave lengths of light each other one of the light beams which is obtained by a scanning operation having a wave length of light which corresponds to the color of the frame;

drive means for moving said scanning means in the same direction for each scanning, thereby causing said scanning means to expose and scan the document;

reading means for receiving the light beams and reading image data on the document;

memory means for storing the image data read by said reading means;

memory control means for storing every scanning into said memory means in tee same order, the image data as read through unidirectional scannings of said scanning means by said reading means;

determining means for determining fame data corresponding to the frame on the document by using the image data stored in said memory means; and image forming means for receiving the light beam and forming onto the copy member, image corresponding to the light beam, with applying the necessary image edition to said image edition area determined by said determining means.

2. The image forming apparatus according to claim 1, wherein said drive means includes means for moving said scanning means two times in the same direction for storing the image data into said memory means.

3. The image forming apparatus according to claim 2, wherein said memory means includes first and second memories, said scanning means includes means for exposing and scanning the document at a first wave length of light for a first scanning and at a second wave length of light for a second scanning, the first wave length being different from the wave length of the light corresponding to the color of said frame defining said image edition area, and the second wave length being equal to the wave length of the light corresponding to the color of said frame, and said memory control means includes means for storing the image data read by said reading means into said first memory in the first scanning, and storing the image data into said second memory in the same order as that when the image data is stored into said first memory means in the second scanning.

4. The image forming apparatus according to claim 3, wherein said determining means includes means for logically multiplying an inversion of the image data stored in said second memory by the the image data stored in said first memory, detecting the frame data on the basis of a result of the multiplying, and determining an area within the frame as the image edition area.

5. The image forming apparatus according to claim 1, wherein a page umber exists in the vicinity of the frame defining said image edition area, the color of said page number is the same as that of the frame, and said image forming apparatus further comprises:

sorter means, with a plurality of trays, for storing and discharging the copy members bearing images formed by said image forming means into said trays;

recognizing means for recognizing a page number on the document by using the image data stored in said memory means; and page control means for selectively discharging the copy members bearing the images into said tray in accordance with the page numbers recognized by said recognizing means.

6. The image forming apparatus according to claim 5, wherein said drive means includes means for moving said scanning means two times in the same direction for storing the image data into said memory means.

7. The image forming apparatus according to claim 6, wherein said memory means includes first and second memories, said scanning means includes means for exposing and scanning the document at a first wave length of light for a first scanning and at a second wave length of light for a second scanning, the first wave length being different from the wave length of the light corresponding to the color of said frame defining said image edition area, and the second wave length being equal to the wave length of the light corresponding to the color of said frame, and said memory control means includes means for storing the image data read by said reading means into said first memory n the first scanning, and storing the image data into said second memory in the same order as that when the image data is stored into said first memory means in the second scanning.

8. The image forming apparatus according to claim 7, wherein said determining means includes image edition area determining means for logically multiplying an inversion of the image data stored in said second memory by the the image data stored in said first memory, detecting the frame data on the basis of a result of the multiplying, and determining an area within the frame as the image edition area.

9. The image forming apparatus according to claim 8, wherein said recognizing means includes page recognition means for determining a remaining image data located outside the image edition area as data of a page number on the basis of the result of the multiplying by said image edition area determining means and for recognizing the page number from the remaining image data.

10. The image forming apparatus according to claim 9, further comprising document supply means for supplying documents sheet by sheet to said scanning means, the documents including first type and second type documents, each of said first type documents having a page number of a color corresponding to said first wave length, and each of said second type documents having a page number surrounded by a frame defining the image edition area and another page number of the same color as that of said frame located near said frame, and wherein said recognizing means includes a second page recognition means for recognizing the page number of said first type document.

11. The image forming apparatus according to claim 10, wherein said determining means includes document deciding means for deciding that the document is said first type document, when deciding on the basis of a result of a logical operation by said image edition area determining means that no frame data exists, and said second page recognition means includes means for recognizing the image data located in a predetermined area as the data of the page number, when said document deciding means decides that the document is said first type document.

12. An image forming apparatus for reading an image on a document, the document having a page number and a frame around the page number, said frame having a color different from that of the image and the page number on the document, and for forming an image onto a copy member, said image forming apparatus comprising:

scanning means for scanning the document a plurality of times to obtain a plurality of light beams which have different wave lengths of light each other, one of the light beams which is obtained by a scanning operation having a wave length of light which corresponds to the color of the frame;

drive means for moving said scanning means in the same direction for each scanning, thereby causing said scanning means to expose and scan the document;

reading means for receiving the light beams and reading image data on the document;

memory means for storing for each scanning the image data read by said reading means;

memory control means for storing every scanning into said memory means in the same order, the image data as read through unidirectional scannings of said scanning means by said reading means;

determining means for determining frame data corresponding to said frame on the document by using the image data stored in said memory means;

recognizing means for recognizing the page number within said frame by using the image data stored in said memory means;

image forming means for receiving the light beam and forming onto the copy member, image corresponding to the light beam, the image formed by said image forming means being lack of said frame determined by said determining means;

sorter means, with a plurality of trays, for sorting and discharging the copy members bearing images formed by said image forming means into said trays;. and page control means for selectively discharging the copy members bearing the images into said trays in accordance with the page numbers recognized by said recognizing means.

13. The image forming apparatus according to claim 12, wherein said drive means includes means for moving said scanning means two times in the same direction for storing the image data into said memory means.

14. The image forming apparatus according to claim 13, wherein said memory means includes first and second memories, said scanning means includes means for exposing and scanning the document at a first wave length of light for a first scanning and at a second wave length of light for a second scanning, the first wave length being different from the wave length of the light corresponding to the color of said frame, and the second wave length being equal to the wave length of the light corresponding to the color of said frame, and said memory control means includes means for storing the image data rad by said reading means into said first memory in the first scanning, and storing the image data into said second memory in the same order as that when the image data is stored into said first memory means in the second scanning.

15. The image forming apparatus according to claim 14, wherein said determining means includes means for logically multiplying an inversion of the image data stored in said second memory by the the image data stored in said first memory, detecting the frame data on the basis of a result of the multiplying, and determining the image data within the frame as the data of page number.

16. The image forming apparatus according to claim 15, wherein said recognizing means includes means for recognizing the image data of page number located within said frame based on the result of the multiplying.

17. The image forming apparatus according to claim 16, further comprising document supply means for supplying documents sheet by sheet to said scanning means.

18. A scanning apparatus for illuminating a document, the document having a frame which defines an image edition area including image to be edited and has an optical characteristic from that of the image on the document, and for distinguishing the frame from the image, said scanning apparatus comprising:

illuminating means for illuminating the document a plurality of times to obtain a plurality of optical characteristic, one of optical characteristic which corresponds to the frame;

drive means for moving said illuminating means s that the document is scanned;

reading means for receiving the light refleted from the document and outputting image data corresponding to the image so that said reading means outputs the image data in accordance with timing of illuminating;

storing means for storing the image data outputted by said reading means;

control means for storing the image data every scanning into said storing means such that relationship between a first position to be stored in said storing means and a second position to be illuminated on the document is same every scanning; and determining means for determining frame data corresponding to the frame on the document by using the image data stored in said storing means.

* * * * *